US010424434B2

(12) United States Patent
Zajc

(10) Patent No.: US 10,424,434 B2
(45) Date of Patent: Sep. 24, 2019

(54) WINDING ARRANGEMENT FOR INDUCTIVE COMPONENTS AND METHOD FOR MANUFACTURING A WINDING ARRANGEMENT FOR INDUCTIVE COMPONENTS

(71) Applicant: Franc Zajc, Komenda (SI)

(72) Inventor: Franc Zajc, Komenda (SI)

( * ) Notice: Subject to any disclaimer, the term of this patent is extended or adjusted under 35 U.S.C. 154(b) by 479 days.

(21) Appl. No.: 14/647,066

(22) PCT Filed: Nov. 26, 2012

(86) PCT No.: PCT/EP2012/073650
§ 371 (c)(1),
(2) Date: May 22, 2015

(87) PCT Pub. No.: WO2014/079516
PCT Pub. Date: May 30, 2014

(65) Prior Publication Data

US 2015/0325361 A1 Nov. 12, 2015

(51) Int. Cl.
*H01F 27/28* (2006.01)
*H01F 27/24* (2006.01)
(Continued)

(52) U.S. Cl.
CPC ..... *H01F 27/2823* (2013.01); *H01F 27/24* (2013.01); *H01F 27/2847* (2013.01);
(Continued)

(58) Field of Classification Search
CPC .... H01F 27/2823; H01F 27/2871; H01F 5/04; H01F 27/2847; H01F 23/5227; H01F 6/06; H01F 17/006
(Continued)

(56) References Cited

U.S. PATENT DOCUMENTS 3,195,088 A * 7/1965 Sandoz ..... H01F 27/2847 336/180
3,633,273 A * 1/1972 Wilburn ..... H01F 27/2847 29/602.1
(Continued)

FOREIGN PATENT DOCUMENTS

DE 100 40 415 C1 1/2002
DE 10040415 C1 * 1/2002 ..... H01F 27/2847
(Continued)

OTHER PUBLICATIONS

International Search Report corresponding to PCT Application No. PCT/EP2012/073650, dated Oct. 7, 2013 (3 pages).

*Primary Examiner* — Tszfung J Chan
(74) *Attorney, Agent, or Firm* — Maginot, Moore & Beck, LLP

(57) ABSTRACT

A winding arrangement for inductive components includes a first winding section comprising at least one first winding, the at least one first winding comprising at least two electrically isolated parallel flat band conductors being configured as a first flat band stack, a second winding section comprising at least one second winding, the at least one second winding comprising at least two electrically isolated parallel flat band conductors being configured as a second flat band stack. The first ends of the flat band conductors of the first winding section are cross connected in a cross connection to first ends of the flat band conductors of the second winding section such that a first current flow stacking sequence in the first flat band stack is reversed to a second current flow stacking sequence in the second flat band stack.

11 Claims, 12 Drawing Sheets

(51) Int. Cl.
*H01F 27/29* (2006.01)
*H01F 41/063* (2016.01)
*H01F 41/064* (2016.01)

(52) U.S. Cl.
CPC ..... *H01F 27/29* (2013.01); *H01F 41/063* (2016.01); *H01F 41/064* (2016.01); *H01F 2027/2857* (2013.01); *Y10T 29/49073* (2015.01)

(58) Field of Classification Search
USPC ..... 336/180, 187, 192, 221, 222, 223, 225, 336/232
See application file for complete search history.

(56) References Cited

U.S. PATENT DOCUMENTS 3,731,244 A 5/1973 Johnson
4,761,628 A * 8/1988 Nishi ..... H01F 29/02 336/180
2008/0122569 A1* 5/2008 Ye ..... H01F 27/2852 336/223
2008/0196239 A1 8/2008 Wang
2008/0231408 A1* 9/2008 Wang ..... H01F 27/2804 336/212
2011/0279208 A1* 11/2011 Ono ..... H01F 27/2852 336/184

FOREIGN PATENT DOCUMENTS

DE 10040415 C1 * 1/2002 ..... H01F 27/2847
EP 2 251 959 A1 11/2010
FR 2 609 205 A1 7/1988
JP S59121908 A 7/1984
JP 2007067982 A 3/2007
JP 2011187600 A 9/2011
WO 2007/136288 A1 11/2007

* cited by examiner

WINDING ARRANGEMENT FOR INDUCTIVE COMPONENTS AND METHOD FOR MANUFACTURING A WINDING ARRANGEMENT FOR INDUCTIVE COMPONENTS

This application is a 35 U.S.C. § 371 National Stage Application of PCT/EP2012/073650, filed on Nov. 26, 2012, the disclosure of which is incorporated herein by reference in its entirety.

TECHNICAL FIELD

The invention relates to a winding arrangement for inductive components and a method for manufacturing a winding arrangement for inductive components.

BACKGROUND

Although applicable to any inductor component, the present invention will be described in combination with inductive components with a high fill factor.

In modern electric and electronic devices winding arrangements for inductive components are an important component. Inductors are especially used in power conversion devices like buck converters and boost converters.

In order to reduce the size of such power conversion devices the working frequencies of said devices become higher. For small power converters up to 10V the working frequencies have risen into the MHz range. For middle sized power converters up to 200V and high power converters up to 500V the target frequency is about 300 kHz to 1 MHz.

In such power conversion devices the inductive components (inductors or transformers) are an important factor regarding losses and size. Particularly, the size of the inductive components should be as small as possible, the shape should be square and the AC/DC resistance ratio should be as low as possible at the desired working frequency.

Common inductive elements—like shown in FIG. 16 comprise a toroidal core TC with a litz or strand wire SW wound around the core TC. Inductors like the one shown in FIG. 16 have a favorable AC/DC current ratio, but such conductors are relatively big and the fill factor is small, especially when additional isolation is required in order to implement secondary windings in transformer applications. Furthermore, the shape of such inductive components is inconvenient to use in modern power conversion devices.

With the constant increase of the working frequency of such power conversion devices the so called "skin effect" becomes more and more relevant when designing power conversion devices. The skin effect is responsible for the current being conducted in a skin area of the conductor, wherein the skin depth δ becomes smaller with higher frequencies. The skin depth δ is about 0.1 mm or less for frequencies in the MHz area. Therefore, the thickness of the conductors of such common inductive elements like the one shown in FIG. 13 is limited to 0.2 mm (2δ). Consequently, the increase of the working frequency results in thinner conductors. The thinner the conductors with round intersection are, the higher the number of litz wires in the litz or strand wire needs to be to conduct the load current. A high number of litz wires results in an even worse fill factor of such inductors.

Inductors can also comprise flat band conductors instead of litz wires. Such inductors are shown in FIGS. 13 and 14, respectively.

FIG. 13 shows an inductor with a magnetic core 1"", wherein the magnetic core 1"" has two winding windows 2*a*"" and 2*b*"". FIG. 13 also shows the flux lines that build up in such an inductor.

A certain percentage of flux lines inevitably passes the winding windows 2*a*"" and 2*b*"", which effects that not all of the winding turns N1, N2 include the same flux causing differences in induced voltage in individual turns. Specifically, as seen in FIG. 13, the core flux Φ surrounds the winding windows 2*a*"" and 2*b*"", while the stressed flux line Φ" passes the winding windows 2*a*"" and 2*b*"". The turn $N_1$ includes $\Phi_1$ flux lines, while the turn $N_2$ includes $\Phi_2$ flux lines. The flux $\Phi_1$ includes complete core flux Φ' and a part of stressed flux Φ" that is represented by $\Phi_1$", while the flux $\Phi_2$ includes the complete core flux Φ' and a part of the stressed flux Φ" that is represented by $\Phi_1$" and $\Phi_2$". Since the stressed flux $\Phi_2$ is greater than the stressed flux $\Phi_1$, and the changes of flux over time are increased as more flux lines are included and the induced voltage in the turn $N_2$ is greater than in turn $N_1$.

In the case of all the winding turns N1, N2 being connected in series, as it is commonly used for the windings of inductive components, the difference in the induced voltage of the winding turns in different positions in the winding windows 2*a*"" and 2*b*"" has no negative effect, because the induced voltages of all winding turns N1, N2 are summed up and therefore cause no equalizing currents.

In order to reduce the ohmic losses caused due to high frequency current, the demand for thinning the conductor thickness increases drastically. The thickness thinning of the conductors with round intersection results in increase of the number of litzes in the strand in order to be able to conduct the load current. The thinner the litz wires are the worse the fill-factor of such winding is. Thinning the square intersection flat conductors limits the maximum possible load current. The load current can be increased by the expansion of the winding window, which is possible only to certain limits set due to the outside inductor dimension ratio. Division of the individual flat conductor strips into more strips is not possible, since interleaving, which is normally used in litz strand conductors cannot be achieved.

However, the flat wires do achieve a much better fill factor than litz wires, since they present an advantage in the possibility of compensating the thinning of the conductors by increasing the width of individual conductors. The simultaneous increase of the length of the winding windows 2*a*"" and 2*b*"" is possible only within certain limits, therefore in such multi-layer windings single flat band conductors connected in parallel to form a single winding presents a possible solution.

Despite the equalizing currents in litz or strand wires being negligible the fill factor deteriorates the high frequency operation for high currents applications, since with the frequency increase the isolator/conductor ratio raises.

Besides the voltage change occurring due to the different position of the winding turns N1, N2 in the winding windows 2*a*"" and 2*b*"" there are also other aspects that deteriorate the high frequency operation for high current applications. The load current of individual winding turns N1, N2 influences the current in all of the other turns of the same winding by creating its own magnetic field causing longitudinal circular current flowing on the inner and outer side of the individual conductor with respect to the core. These longitudinal circular currents are summed up with the load current, such that the load current is increased on the inner side of the conductor and decreased on the outer side of the conductor, this phenomena is called proximity effect. The consequence of the proximity effect are greater ohmic losses with the increase of frequency.

Using flat band conductors in parallel solves the skin and proximity effect, while simultaneously allowing the same load current to flow through the winding as the effective conductive area remains the same. Specifically, FIG. 14 shows a magnetic core 1''' with a winding with a single conductor which is divided into two parallel flat band strips $S_1$'' and $S_2$'' isolated between each other and surrounding the gap $G_W$''. The parallel flat band strips $S_1$'' and $S_2$'' are short circuited in connection areas 3 providing taps $T_1$ and $T_2$ to form a single conductor is demonstrated in FIG. 14.

Dividing individual conductors into flat band strips solves the fill factor, skin effect and proximity effect issue at the same time. The flux leakage into the area of the winding windows 2*a*'''' and 2*b*'''' cannot be removed. The flux tends to flow through low permeability areas such as isolator or air in the winding window area and partly through the conductors. The gap $G_W$'' between both parallel conductor strips $S_1$'' and $S_2$'' presents an area for the flux lines $\Phi_W$ to penetrate into it resulting in a voltage difference $\Delta V$ among individual parallel conductor strips $S_1$'' and $S_2$'' of the same conductor.

Therefore, an additional voltage causing longitudinal current $I_{WL}$ through parallel conductor strips $S_1$'' and $S_2$'' and both connection taps $T_1$'''', $T_2$'''' appears, as demonstrated in FIG. 15. In FIG. 15 a winding W'' is shown, with two parallel conductor strips $S_1$'' and $S_2$'' and the gap $G_W$'' between the parallel conductor strips $S_1$'' and $S_2$'', wherein the flux $\Phi_G$ penetrates the gap $G_W$''. This voltage equalizing longitudinal current $I_{WL}$ is added to the load current as the summation of both contributions. The induced longitudinal current $I_{WL}$ is a problem in paralleled conductor strips which is similar to the problems caused by the proximity effect.

Document WO 2007/136288A1 shows a method for winding a high-frequency transformer by winding a strip of electrically conductive material around a core in two parallel windings.

SUMMARY

This problem is solved by the features of the independent claims.

Accordingly, the present patent application provides:

A winding arrangement for inductive components, comprising a first winding section comprising at least one first winding, the at least one first winding comprising at least two electrically isolated parallel flat band conductors being configured as a first flat band stack, a second winding section comprising at least one second winding, the at least one second winding comprising at least two electrically isolated parallel flat band conductors being configured as a second flat band stack, wherein first ends of the flat band conductors of the first winding section are cross connected in a cross connection to first ends of the flat band conductors of the second winding section such that a first current flow stacking sequence in the first flat band stack is reversed to a second current flow stacking sequence in the second flat band stack, wherein second ends of the flat band conductors of the first winding section are at least electrically connected in a first electric tap, and wherein second ends of the flat band conductors of the second winding section are at least electrically connected in a second electric tap.

An electric transformer, comprising at least one winding arrangement for inductive components according to the invention.

A method for manufacturing a winding arrangement for inductive components, comprising the steps of providing a first winding section comprising at least one first winding, the at least one first winding comprising at least two electrically isolated parallel flat band conductors, the first winding being configured as flat band stack, providing a second winding section comprising at least one second winding, the at least one second winding comprising at least two electrically isolated parallel flat band conductors, the second winding being configured as flat band stack, winding the at least one first winding, winding the at least one second winding, and cross connecting the flat band conductors of the first winding section to the flat band conductors of the second winding section such that a first current flow stacking sequence in the first flat band stack is reversed to a second current flow stacking sequence in the second flat band stack, connecting second ends of the flat band conductors of the first winding section at least electrically in a first electric tap, and connecting second ends of the flat band conductors of the second winding section at least electrically in a second electric tap.

The present invention is based on the idea that the longitudinal current through parallel conductor strips should be eliminated to improve the efficiency of an inductor.

Therefore, the present invention provides a winding arrangement for inductive components where the winding of the inductor is divided into two separate winding sections. Furthermore, the single winding section each comprises at least one winding, which is formed of a flat band stack of flat band conductors.

In order to effectively remove the longitudinal current through parallel conductor strips the connection between the first flat band stack of the first winding section and the second flat band stack of the second winding section is arranged as a cross connection. Furthermore, the first flat band stack forms a first winding which is wound in a first direction and the second flat band stack forms a second winding, which is wound in a second direction which is opposite to the first direction.

Concerning the present patent application "cross connection" means that the flat band conductors of the first winding section are connected to the flat band conductors of the second winding section in reversed order. That means the first flat band conductor of the first winding section is connected to the last flat band conductor of the second winding section, the second flat band conductor of the first winding section is connected to the second to last flat band conductor of the second winding section, and so forth. Therefore a first current flow stacking sequence in the first flat band stack is reversed compared to a second current flow stacking sequence in the second flat band stack.

Finally, the ends of the flat band conductors which exit the first winding section and the second winding section, respectively, are electrically connected together in each case to form electrical taps, which are used to electrically interface the inductor.

The cross connection according to the present invention greatly reduces longitudinal currents in parallel flat band conductors. Thus, the flat conductor strips can be used and the effective intersection area of the winding window is increased and the DC/AC resistance ratio is reduced. The parallel arrangement of the flat band strips in each individual winding allows the intersection to be adapted to different winding window shapes. Furthermore, the parallel arrangement of the flat band conductors allows narrowing of the strips and, therefore, lowers the parasitic capacitance of the windings.

Finally, the ohmic losses are reduced in an inductor according to the present invention. Consequently, further frequency increases with simultaneous reductions in size become possible.

Further embodiments of the present invention are subject of the dependent claims and of the following description, referring to the drawings.

In one embodiment the at least one first winding is wound in a first winding direction with regard to a virtual axis of the winding arrangement for inductive components and the at least one second winding is wound in a second winding direction being opposite to the first winding direction with regard to the virtual axis of the winding arrangement for inductive components.

In a preferred embodiment of the winding arrangement for inductive components at least one first winding is wound on a first magnetic core and at least one second winding is wound around a second magnetic core.

In a preferred embodiment the stacking sequence is reversed through the at least one first winding and the at least one second winding being wound around the first magnetic core and the second magnetic core, respectively, in an s-shaped arrangement. This allows providing a reverse current flow stacking sequence in the first winding section compared to the second winding section without, the need to explicitly provide a cross section, because the cross section is implicitly formed by the s-shaped arrangement.

In a preferred embodiment the winding arrangement for inductive components comprises a magnetic core, the first winding section including the at least one first winding being wound around the core in the first winding direction and the second winding section including the at least one second winding being wound around the core in the second winding direction connected between each other with the cross-connection. Using a magnetic core further improves the inductivity of the winding arrangement for inductive components according to the present invention.

In a preferred embodiment the first winding section and the second winding section are configured essentially symmetrical. If the first winding section and the second winding section are configured essentially symmetrical the longitudinal currents in parallel flat band conductors are optimally reduced.

In the context of the present patent application the term "symmetrical" does not necessarily refer to a mechanical or geometrical symmetry. Rather, the term symmetrical can also refer to electrically symmetry. This means that in both winding sections the same electrical voltage is induced or that both winding sections circumvent the same amount of magnetic flux between the individual parallel conductive flat bands.

In a preferred embodiment the first winding section comprises at least two first windings, the electrical conductors of the at least two first windings being connected electrically in series in a direct connection and the at least two first windings being wound in alternating directions.

In a preferred embodiment the second winding section comprises at least two second windings, the electrical conductors of the at least two second windings being connected electrically in series in a direct connection and the at least two second windings being wound in alternating directions.

Providing the first winding section and the second winding section with a plurality of windings allows further reducing the capacitance of the winding sections.

In a preferred embodiment the cross connection is arranged at the innermost loop of the at least one first winding and the at least one second winding. This allows integrating the cross connection into the inductor and building a very compact inductor.

In a preferred embodiment the cross connection is arranged at the outermost loop of the at least one first winding and the at least one second winding. On the outer region of the windings there is more space available for the cross connection. Therefore, easy construction and assembly of the winding arrangement for inductive components becomes possible.

In a preferred embodiment the cross connection is implemented by an electric wiring arrangement. This allows providing a very simple cross connection.

In a preferred embodiment the cross connection is implemented by a folding arrangement of the at least one first winding section and/or the at least one second winding section. This allows providing a very compact cross connection which can be embedded deeply in the winding arrangement for inductive components without the need to establish the cross connection using e.g. soldering tools.

In a preferred embodiment the first winding section and the second winding section with the cross connection in between are implemented by a folding arrangement of one single longitudinal flat band stack. This allows providing a very simple and, therefore, cost effective arrangement for the windings of the winding arrangement for inductive components.

In a preferred embodiment the first winding section and the second winding section with the cross connection in between are implemented by a folding arrangement of one u-shaped flat band stack, the first winding section being formed by a first arm of the u-shaped flat band stack, the second winding section being formed by a second arm of the u-shaped flat band stack, and the cross section being formed by a connection element of the u-shaped flat band stack, which connection element connects the first arm and the second arm of the u-shaped flat band stack. This allows providing a very compact cross connection.

BRIEF DESCRIPTION OF THE DRAWINGS

For a more complete understanding of the present invention and advantages thereof, reference is now made to the following description taken in conjunction with the accompanying drawings. The invention is explained in more detail below using exemplary embodiments which are specified in the schematic figures of the drawings, in which.

Figure 1:
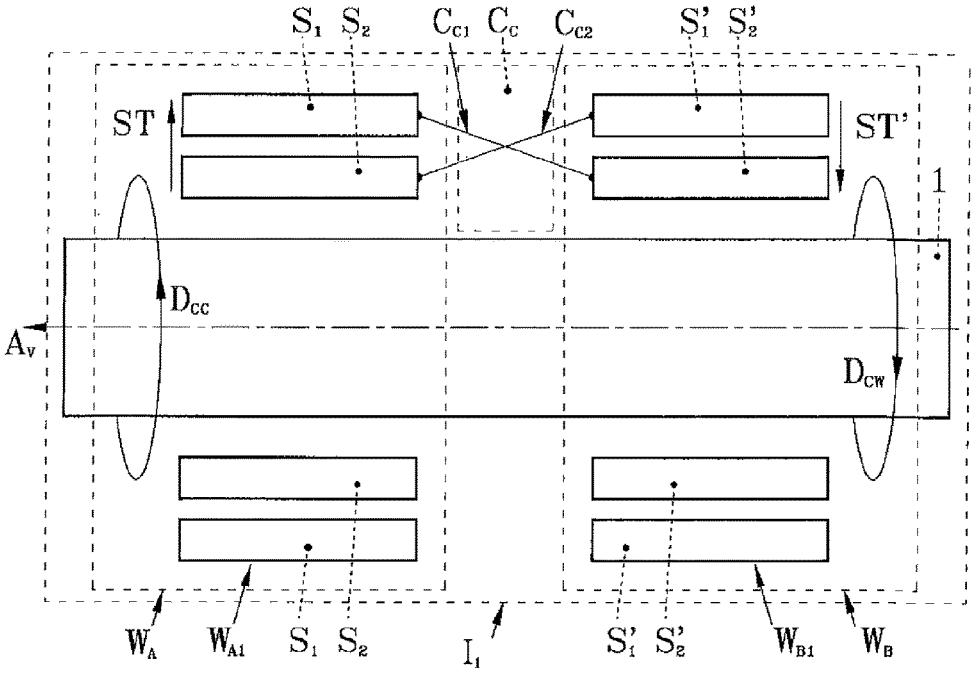
FIG. 1 shows a block diagram of a first embodiment of a winding arrangement for inductive components according to the present invention.

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily drawn to scale relative to each other. Like reference numerals designate corresponding similar parts.

DETAILED DESCRIPTION OF THE DRAWINGS

FIG. 1 shows a block diagram of a first embodiment of a winding arrangement for inductive components I1 according to the present invention.

The winding arrangement for inductive components I1 of FIG. 1 comprises a magnetic core 1 which lies in a virtual axis $A_V$ of the winding arrangement for inductive components I1, a first winding section $W_A$ and a second winding section $W_B$. The first winding section $W_A$ comprises one first winding $W_{A1}$ which is wound from the top of the magnetic core 1 around the back of the magnetic core 1 to the bottom of the magnetic core 1 in a first winding direction $D_{CC}$. The second winding section $W_B$ comprises one second winding $W_{B1}$ which is wound from the top of the magnetic core 1 around the front of the magnetic core 1 to the bottom of the magnetic core 1 in a second winding direction $D_{CW}$.

The first winding $W_{A1}$ comprises two flat band conductors $S_1$, $S_2$ being configured as a first flat band stack ST.

The second winding $W_{B1}$ also comprises two flat band conductors $S_1'$, $S_2'$ being configured as a second flat band stack ST'.

Finally first ends of the flat band conductors $S_1$, $S_2$ and $S_1'$, $S_2'$ are cross connected in a cross connection $C_C$, $C_{C1}$-$C_{C2}$ such that a first current flow stacking sequence in the first flat band stack ST is reversed to a second current flow stacking sequence in the second flat band stack ST'. Precisely, flat band conductor $S_1$ is connected to flat band conductor $S_2'$ and flat band conductor $S_2$ is connected to flat band conductor $S_1'$.

Figure 2:
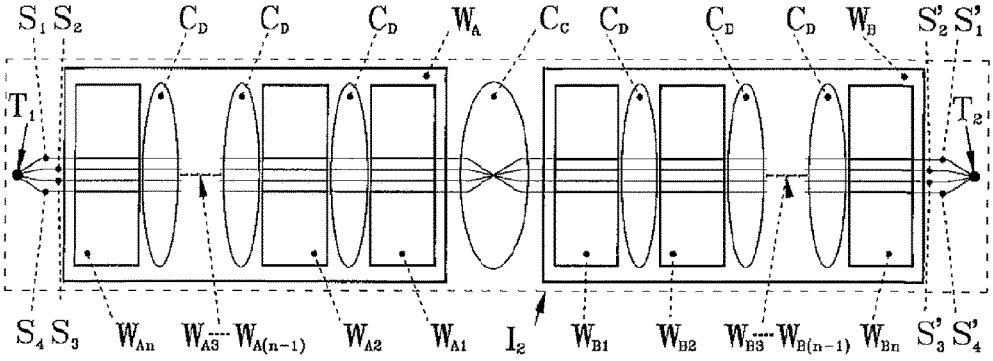
FIG. 2 is a block diagram of a second embodiment of a winding arrangement for inductive components according to the present invention.

FIG. 2 is a block diagram of a second embodiment of a winding arrangement for inductive components I2 according to the present invention.

The winding arrangement for inductive components I2 comprises a first winding section $W_A$ and a second winding section $W_B$. The first winding section $W_A$ comprises a plurality of first windings $W_{A1}$-$W_{An}$, wherein only three of the first windings $W_{A1}$, $W_{A2}$ and $W_{An}$ are displayed. The second winding section $W_B$ comprises a plurality of second windings $W_{B1}$-$W_{Bn}$, wherein only three of the second windings $W_{B1}$, $W_{B2}$ and $W_{Bn}$ are displayed. The first windings $W_{A1}$-$W_{An}$, and the second windings $W_{B1}$-$W_{Bn}$, respectively, are connected in series with a direct connection $C_D$ in each case. The position of the direct connection $C_D$ alternates between Between the first winding section $W_A$ and the second winding section $W_B$ the innermost windings $W_{A1}$ and $W_{B1}$ are cross connected in a cross connection $C_C$.

Finally, the ends of the flat band connectors $S_1$-$S_4$ of the first winding section $W_A$ are electrically connected together in a first tap $T_1$ and the ends of the flat band connectors $S_1'$-$S_4'$ of the second winding section $W_B$ are electrically connected together in a first tap $T_2$.

In FIG. 2 a plurality of possible first windings $W_{A3}$-$W_{A(n-1)}$ and a plurality of possible second windings $W_{B3}$-$W_{B(n-1)}$ are suggested by a dotted line. Therefore, the winding arrangement for inductive components of FIG. 2 could have an arbitrary number of first windings $W_{A1}$-$W_{An}$ and second windings $W_{B1}$-$W_{Bn}$.

In FIG. 2 the first winding section $W_A$, the second winding section $W_B$, the first windings $W_{A1}$-$W_{An}$ and the second windings $W_{B1}$-$W_{Bn}$ are displayed as rectangular boxes for illustration purpose.

Figure 3:
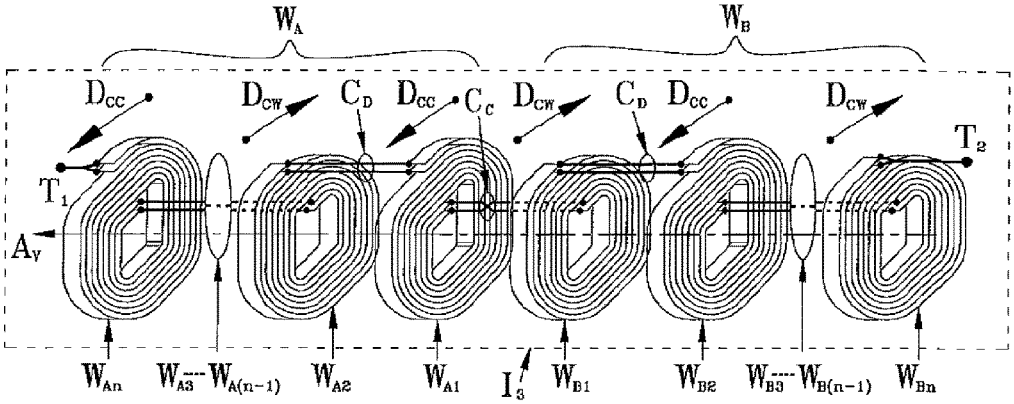
FIG. 3 is a block diagram of a third embodiment of a winding arrangement for inductive components according to the present invention.

FIG. 3 is a block diagram of a third embodiment of a winding arrangement for inductive components I3 according to the present invention.

The winding arrangement for inductive components I3 of FIG. 3 differs from the winding arrangement for inductive components I3 of FIG. 2 in that the first windings $W_{A1}$-$W_{An}$ and the second windings $W_{B1}$-$W_{Bn}$ are displayed as windings comprising two flat band conductors each.

In FIG. 3 as in FIG. 2 the first winding section $W_A$ comprises a plurality of first windings $W_{A1}$-$W_{An}$ wherein only three of the first windings $W_{A1}$, $W_{A2}$ and $W_{An}$ are displayed. The second winding section $W_B$ comprises a plurality of second windings $W_{B1}$-$W_{Bn}$, wherein only three of the second windings $W_{B1}$, $W_{B2}$ and $W_{Bn}$ are displayed. A plurality of possible first windings $W_{A3}$-$W_{A(n-1)}$ and a plurality of possible second windings $W_{B3}$-$W_{B(n-1)}$ are suggested by a dotted line. Therefore, the winding arrangement for inductive components of FIG. 3 could have an arbitrary number of first windings $W_{A1}$-$W_{An}$ and second windings $W_{B1}$-$W_{Bn}$.

In FIG. 3 over every one of the first windings $W_{A1}$-$W_{An}$ and the second windings $W_{B1}$-$W_{Bn}$ the winding direction is displayed with an arrow. Furthermore the windings are wound around a virtual axis $A_V$ of the inductor I3.

The first winding direction $D_{CC}$ in FIG. 3 is defined as a winding starting with the innermost loop on top of a not displayed magnetic core 1, winding in front of the not displayed magnetic core 1 to the bottom of the not displayed magnetic core 1. The second winding direction $D_{CW}$ is opposite to the first winding direction $D_{CC}$.

In FIG. 3 the first windings $W_{A1}$ and $W_{An}$ and the second winding $W_{B2}$ are wound in the first winding direction $D_{CC}$.

The first winding $W_{A2}$ and the second windings $W_{B1}$ and $W_{Bn}$ are wound in the second winding direction $D_{CW}$.

FIG. 3 shows that within a single winding section $W_A$ and $W_B$ a division into more individual windings $W_{A1}$-$W_{An}$ and $W_{B1}$-$W_{Bn}$ is possible. Dividing the winding sections $W_A$ and $W_B$ into more individual windings $W_{A1}$-$W_{An}$ and $W_{B1}$-$W_{Bn}$ reduces the leakage capacity of the windings as the adjacent surface between the turns is reduced due to a reduced flat band conductor strip width. The individual windings $W_{A1}$-$W_{An}$ form the first winding section $W_A$ and the individual windings $W_{B1}$-$W_{Bn}$ form the second winding section $W_B$. Within each winding section the windings $W_{A1}$-$W_{An}$ and $W_{B1}$-$B_{Bn}$ are connected with a direct connection $C_D$, while for the connection between both individual winding sections $W_A$ and $W_B$ the cross connection $C_C$ is necessary.

In one embodiment the number of the individual windings within one winding section is the same for both winding sections $W_A$ and $W_B$.

Finally, the ends of the flat band connectors $S_1$-S2 of the first winding $W_{An}$ are electrically connected together in a first tap $T_1$ and the ends of the flat band connectors $S_1'$-$S_4'$ of the second winding $W_{Bn}$ are electrically connected together in a first tap $T_2$.

Figure 4:
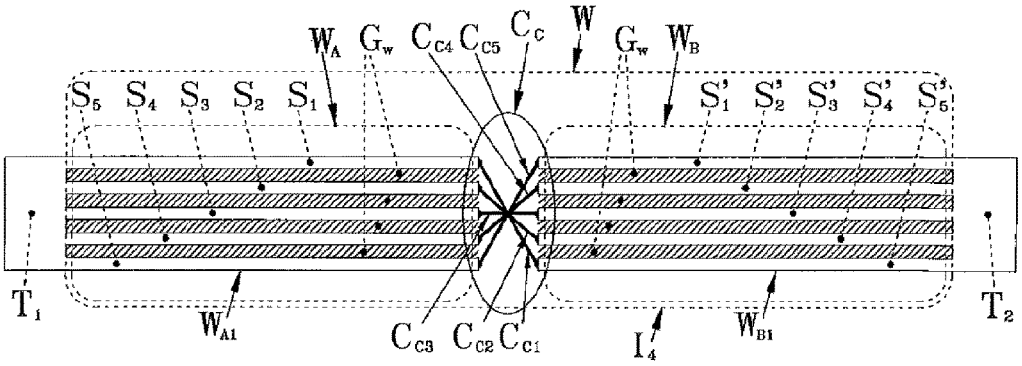
FIG. 4 is a schematic presentation of a fourth embodiment of a winding arrangement for inductive components according to the present invention, where stretched first and second windings with a cross connection are shown in detail.

FIG. 4 is a schematic presentation of a fourth embodiment of a winding arrangement for inductive components I4 according to the present invention, where stretched first and second windings $W_{A1}$ and $W_{B1}$ with a cross connection $C_C$ are shown in detail.

The windings in FIG. 4 each comprise five flat band conductors $S_1$-$S_5$ and $S_1'$-$S_5'$. At the outer end of the first winding section $W_A$ the ends of the flat band conductors $S_1$-$S_5$ are electrically connected together in a first tab $T_1$. The ends of the flat band conductors $S_1'$-$S_5'$ are electrically connected together in a second tab $T_2$ at the outer end of the second winding section $W_B$. Between the flat band conductors $S_1$-$S_5$ and $S_1'$-$S_5'$ a gap G is arranged.

In the middle, between the first winding section $W_A$ and the second winding section $W_B$ the single flat band conductors $S_1$-$S_5$ of the first winding section $W_A$ and the single flat band conductors $S_1'$-$S_5'$ of the second winding section $W_B$ are connected to each other in a cross connection $C_C$.

In FIG. 4 there is one cross connection $C_{C1}$-$C_{C5}$ for every pair of flat band conductors $S_1$-$S_5$ and $S_1'$-$S_5'$.

The first flat band conductors $S_1$-$S_5$ of the first winding section $W_A$ are connected to the second flat band conductors $S_1'$-$S_5'$ of the second winding section $W_B$ in the manner to change the current flow stacking sequence, such that the first flat band conductor $S_1$ of the first winding section $W_A$ is connected to the second flat band conductor $S_5'$ of the second winding section $W_B$, the first flat band conductor $S_2$ of the first winding section $W_A$ is connected to the second flat band conductor $S_4'$ of the second winding section $W_B$, and so on. The number of the insulated flat conductor strips is the same for both winding sections $W_A$ and $W_B$.

Figure 5:
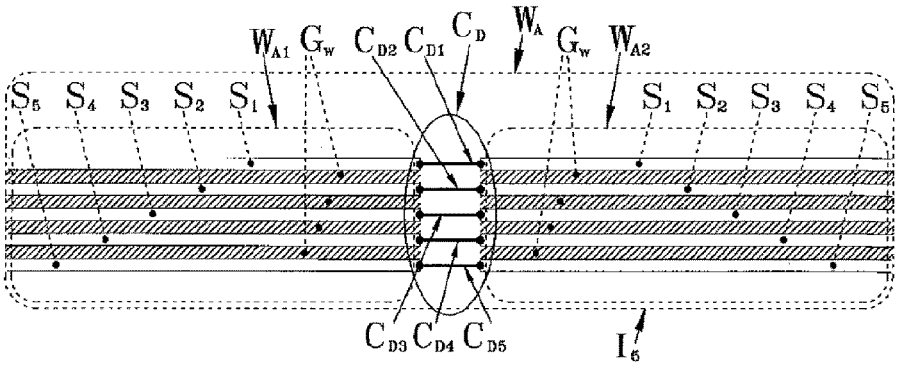
FIG. 5 is a schematic presentation of a fifth embodiment of a winding arrangement for inductive components according to the present invention, where two stretched first windings with a direct connection are shown in detail.

FIG. 5 is a schematic presentation of a fifth embodiment of a winding arrangement for inductive components I5 according to the present invention, where two stretched first windings $W_{A1}$ and $W_{A2}$ with a direct connection $C_D$ are shown in detail. The same arrangement is possible for two stretched second windings $W_{B1}$ and $W_{B2}$.

One direct connection $C_{D1}$-$C_{D5}$ is provided for every one of the first flat band conductors $S_1$-$S_5$. The first flat band conductors $S_1$-$S_5$ of the first winding $W_{A1}$ are connected to the first flat band conductors $S_1$-$S_5$ of the first winding $W_{A2}$ in the manner to keep the current flow stacking sequence unchanged, such that the first flat band conductor $S_1$ of the first winding $W_{A1}$ is connected to the first flat band conductors $S_1$ of the first winding $W_{A2}$, that the first flat band conductor $S_2$ of the first winding $W_{A1}$ is connected to the first flat band conductors $S_2$ of the first winding $W_{A2}$, and so on. The number of flat band conductors $S_1$-$S_5$ is the same for both symmetrical windings. In the embodiment of FIG. 5 the windings $W_{A1}$ and $W_{A2}$ consist of five first flat band conductors $S_1$-$S_5$. In other embodiments another number of flat band conductors $S_1$-$S_5$ is possible. Between the flat band conductors $S_1$-$S_5$ a gap $G_W$ is arranged.

Figure 6:
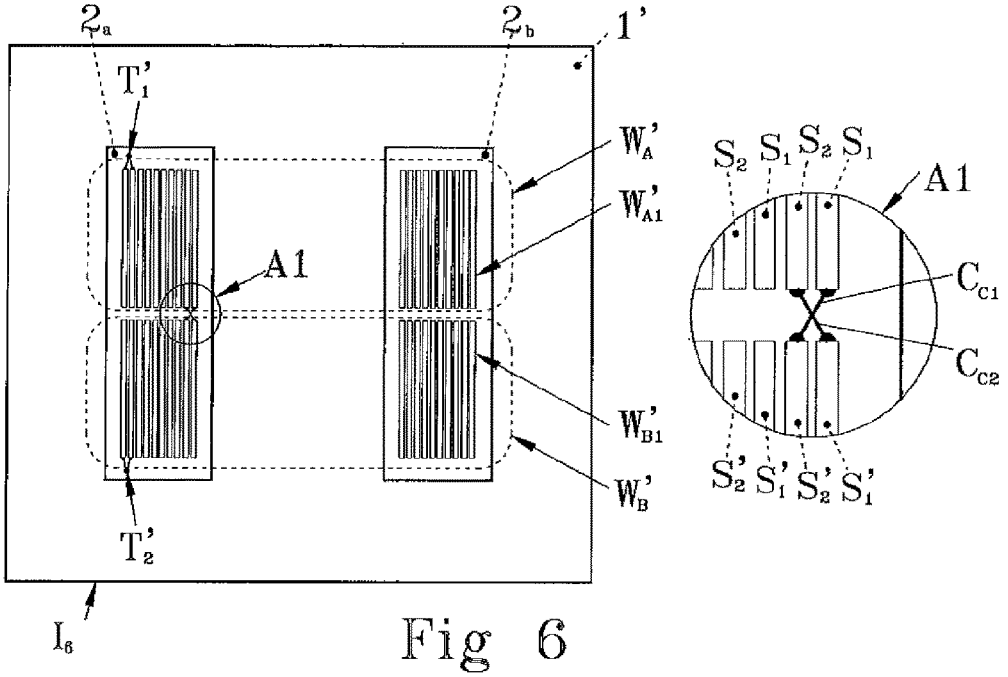
FIG. 6 shows a vertical cross section of a sixth embodiment of a winding arrangement for inductive components according to the present invention.

FIG. 6 shows a vertical cross section of a sixth embodiment of a winding arrangement for inductive components I6 according to the present invention.

The vertical cross section of a preferred embodiment of the winding arrangement for inductive components I6 according to the present invention shows a magnetic core 1' with winding windows 2*a*' and 2*b*'. In the winding windows 2*a*' and 2*b*' are arranged a first winding section $W_A'$ and a second winding section $W_B'$, the first winding section $W_A'$ comprising a first winding $W_{A1}'$ and the second winding section $W_B'$ comprising a second winding $W_{B1}'$. Each one, the first winding $W_{A1}$ and the second winding $W_{B1}$ comprises two flat band conductors $S_1$, $S_2$ and $S_1'$, $S_2'$ and has five turns.

The position of the cross connection $C_C$1, $C_C$2 of the first winding $W_{A1}$ of the first winding section $W_A$ with the second winding $W_{B1}$ of the second winding section $W_B$ is at the innermost turn of the first winding $W_{A1}$ and the second winding $W_{B1}$. A magnified version of the cross connection is shown in an enlargement A1.

A cross connection $C_{C1}$ connects the flat band conductor $S_1$ of the first winding $W_{A1}$ of the first winding section $W_A'$ to the flat band conductors $S_2'$ of the second winding $W_{B1}$ of the second winding section $W_B'$. Furthermore, a cross connection $C_{C2}$ connects the flat band conductor $S_2$ of the first winding $W_{A1}$ of the first winding section $W_A'$ to the flat band conductors $S_1'$ of the second winding $W_{B1}$ of the second winding section $W_B'$. The cross sections are shown in detail in enlargement A1.

For the first winding $W_{A1}$ and the second winding $W_{B1}$ a tap $T_1$ and a Tap $T_2$, respectively, are arranged on the outer side of the respective winding $W_{A1}$, $W_{B1}$ to form convenient contacts of the winding arrangement for inductive components I6.

Figure 7:
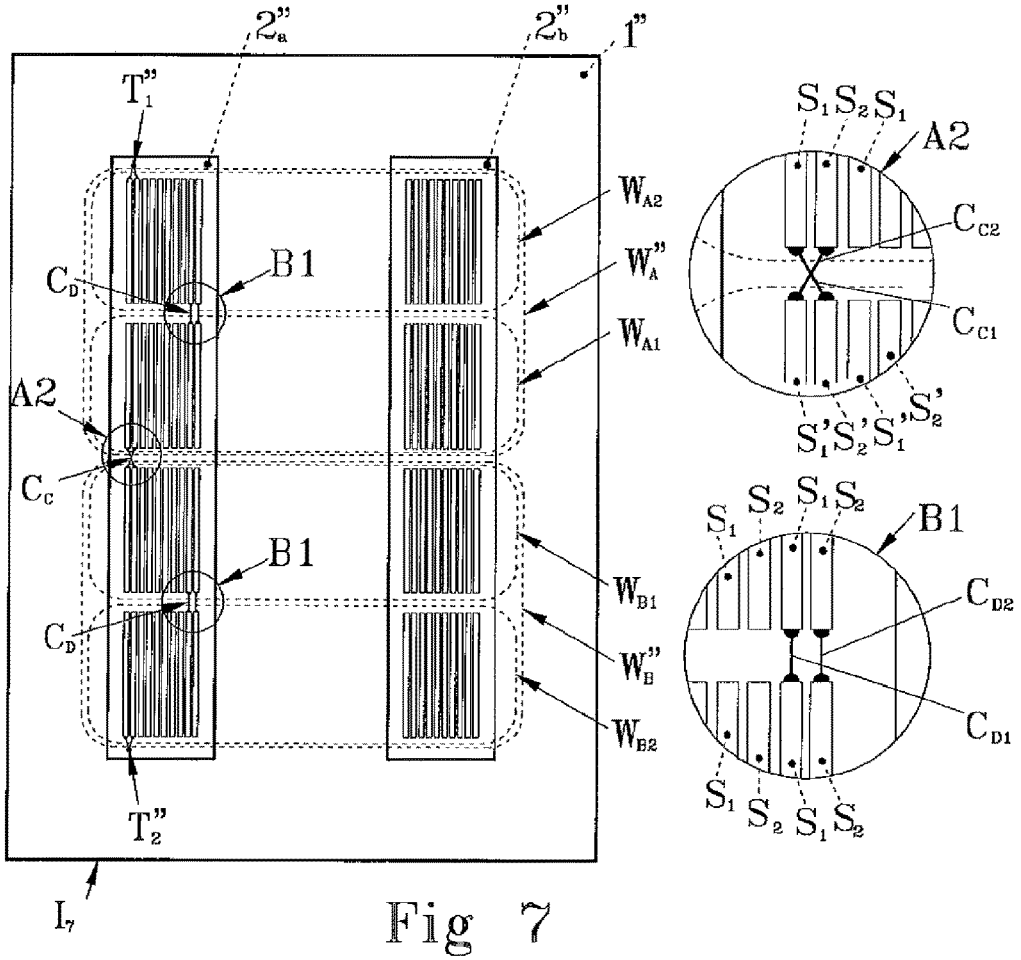
FIG. 7 shows a vertical cross section of a seventh embodiment of a winding arrangement for inductive components according to the present invention.

FIG. 7 shows a vertical cross section of a seventh embodiment of a winding arrangement for inductive components I7 according to the present invention.

The vertical cross section of a preferred embodiment of the winding arrangement for inductive components I7 according to the present invention shows a magnetic core 1"

with winding windows 2*a*" and 2*b*". In the winding windows 2*a*" and 2*b*" are arranged a first winding section $W_A$" and a second winding section $W_B$".

The vertical cross section of a preferred embodiment of the winding arrangement for inductive components I7 according to the present invention differs from the winding arrangement for inductive components I6 of FIG. 6 in that the cross section $C_C$ is arranged at the outermost turn of the first winding $W_{A1}$ and the second winding $W_{B1}$. Furthermore, the first winding section $W_A$" comprises a first winding $W_{A1}$ and a first winding $W_{A2}$ and the second winding section $W_B$" comprises a second winding $W_{B1}$ and a second winding $W_{B2}$.

Between the first winding $W_{A1}$ and the first winding $W_{A2}$ a direct connection $C_{D1}$ connects the flat band conductor $S_1$ of the winding $W_{A1}$ to the flat band conductor $S_1$ of the winding $W_{A2}$. Furthermore, a direct connection $C_{D2}$ connects the flat band conductor $S_2$ of the winding $W_{A1}$ to the flat band conductor $S_2$ of the winding $W_{A2}$. The direct connection is shown in detail in enlargement B1.

Analogous direct connections $C_{D1}$ and $C_{D2}$ are established between the flat band conductor $S_1$' of the winding $W_{B1}$ to the flat band conductor $S_1$' of the winding $W_{B2}$ and the flat band conductor $S_2$' of the winding $W_{B1}$ and the flat band conductor $S_2$' of the winding $W_{B2}$.

A cross connection $C_{C1}$ connects the flat band conductor $S_1$ of the first winding $W_{A1}$ of the first winding section $W_A$' to the flat band conductors $S_2$' of the second winding $W_{B1}$ of the second winding section $W_B$'. Furthermore, a cross connection $C_{C2}$ connects the flat band conductor $S_2$ of the first winding $W_{A1}$ of the first winding section $W_A$' to the flat band conductors $S_1$' of the second winding $W_{B1}$ of the second winding section $W_B$'. The cross sections are shown in detail in enlargement A2.

For the first winding $W_{A2}$ and the second winding $W_{B2}$ a tap $T_1$" and a Tap $T_2$", respectively, are arranged on the outer side of the respective winding $W_{A2}$, $W_{B2}$ to form convenient contacts of the winding arrangement for inductive components I7.

Figure 8:
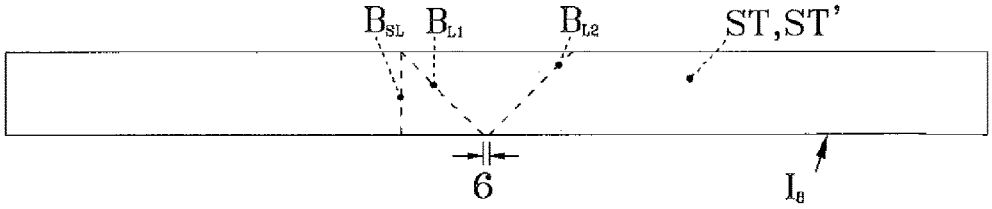
FIG. 8 is a top view of an eighth embodiment of a winding arrangement for inductive components according to the present invention, where a flat band stack is shown in detail.

FIG. 8 is a top view of an eighth embodiment of a winding arrangement for inductive components I8 according to the present invention, where a flat band stack ST, ST' is shown in detail.

The flat band stack ST, ST' extends longitudinally such that the length of the flat band stack ST, ST' is larger than the width of the flat band stack ST, ST'.

In FIG. 8 three folding lines $B_{L1}$, $B_{L2}$ and $B_{LS}$ are indicated on the flat band stack ST, ST'. The first folding line $B_{L1}$ starts at the bottom of the middle of the flat band stack ST, ST' and runs in a 45° angle to the left of the flat band stack ST, ST' until reaching the top edge of the flat band stack ST, ST'. Furthermore, the second folding line $B_{L2}$ starts at the bottom of the middle of the flat band stack ST, ST' and runs in a 45° angle to the right of the flat band stack ST, ST' until reaching the top edge of the flat band stack ST, ST'. Finally, the third folding line $B_{SL}$ runs from the point, where the first folding line $B_{L1}$ crosses the top edge of the flat band stack ST, ST' orthogonally to the bottom of the flat band stack ST, ST'.

FIG. 8 *a,b,c* are perspective views of the flat band stack ST, ST' of the eighth embodiment shown in FIG. 8 in various winding steps.

The sequence of the FIGS. 8*a*, 8*b*, 8*c*, 8*d* demonstrates the sequence of the folding procedure. The flat band stack ST, ST' comprises three flat band conductors $S_1$, $S_2$, $S_3$.

Figure 8A:
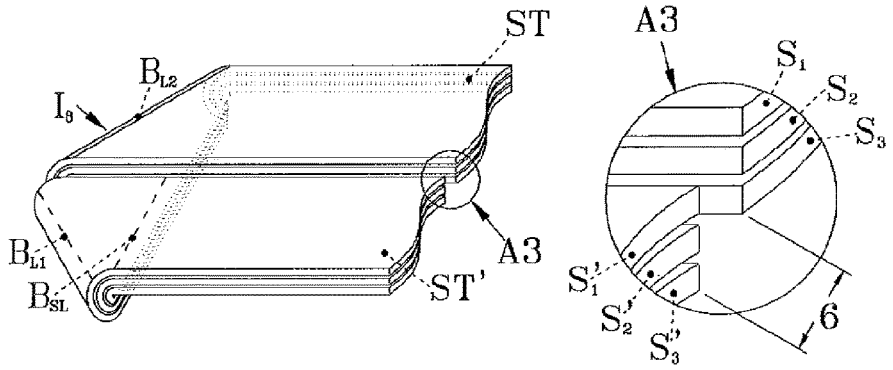
FIG. 8*a,b,c,d* are perspective views of the flat band stack of the eighth embodiment shown in FIG. 8 in various winding steps.

The flat band stack ST, ST' is bent in the same direction on the folding lines $B_{L1}$ and $B_{L2}$. The folding along folding lines $B_{L1}$ and $B_{L2}$ of FIG. 8*a* results in a essentially u-shaped flat band stack ST, ST'. The folding line $B_{SL}$ is indicated on the second flat band stack ST'. This is shown in FIG. 8*a*. Furthermore, in FIG. 8*a* an enlargement A3 shows the stacking sequence of the flat band conductors $S_1$, $S_2$, $S_3$ and the flat band conductors $S_1$', $S_2$', $S_3$'.

Figure 8B:
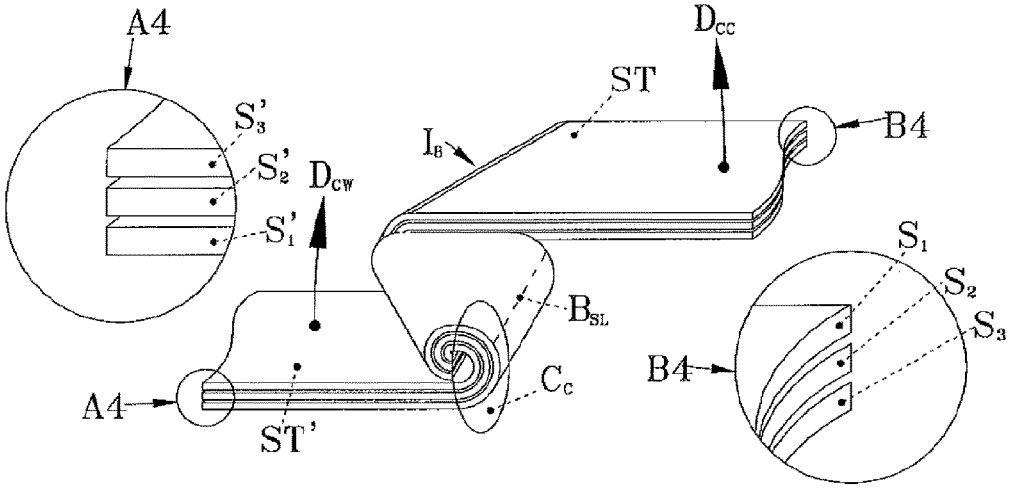

FIG. 8*b* shows the flat band stack ST, ST' after bending the flat band stack ST, ST' at folding line $B_{SL}$, which inherently results in a reversed current flow stacking sequence and therefore performs the cross connection $C_C$. In FIG. 8*b* an enlargement A4 shows the stacking sequence of the flat band conductors $S_1$, $S_2$, $S_3$ and an enlargement B4 shows the stacking sequence of the flat band conductors $S_1$', $S_2$', $S_3$'. Furthermore, the folding directions $D_{CC}$ and $D_{CW}$, respectively, are both indicated in the flat band stacks ST and ST'.

The first two foldings in FIG. 8*a* separate both winding sections $W_A$ and $W_B$, but do not change current flow stacking sequence. The current flow stacking sequence of both winding sections $W_A$ and $W_B$ remains the same, namely $S_1$, $S_2$, $S_3$. The current flow stacking sequence changing is performed by bending over stack bending lines $B_{SL}$ and a perspective view of the complete cross connection $C_C$ execution is shown in FIG. 8*b*, wherein the current flow stacking sequence of the first winding section $W_A$ is $S_1$, $S_2$, $S_3$, while the current flow stacking sequence of the second winding section $W_B$ is inverted $S_3$', $S_2$', $S_1$'.

Figure 8C:
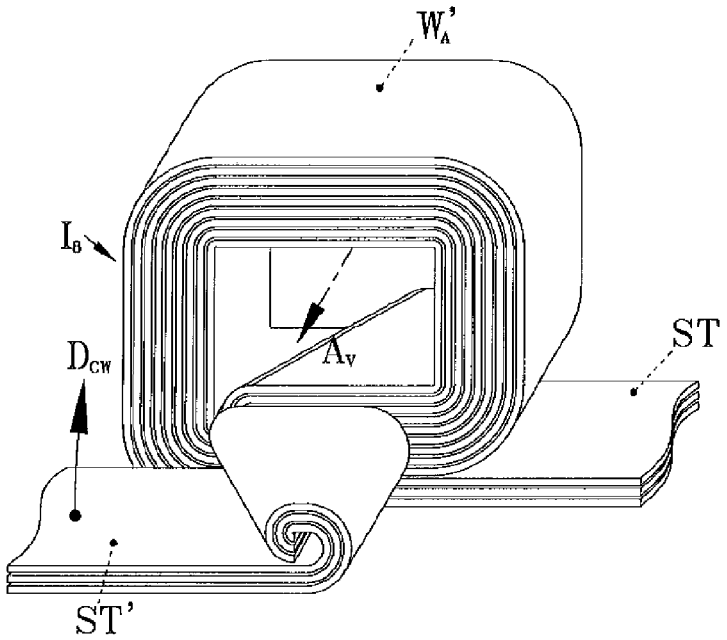

First winding $W_{A1}$ is wound counterclockwise in the first winding direction $D_{CC}$ as shown in FIG. 8*c*. Second winding $W_{B1}$ is wound clockwise in the second winding direction $D_{CC}$ as shown in FIG. 8*d*.

Figure 8D:
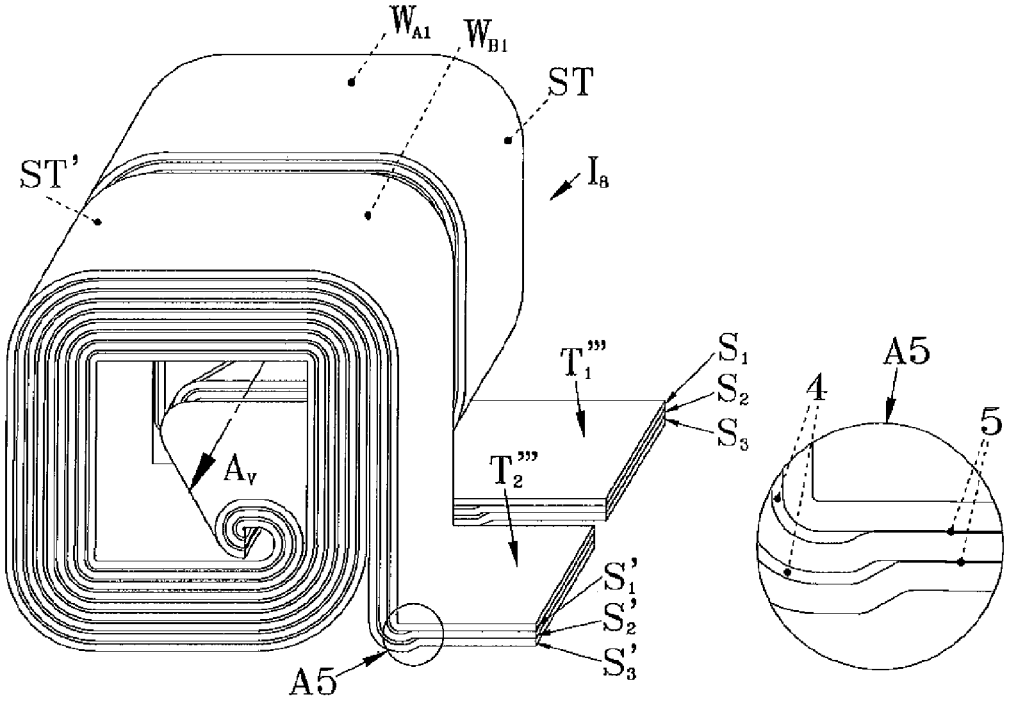

FIG. 8*d* shows one preferred embodiment of the winding arrangement for inductive components I8. The flat band conductors $S_1$ to $S_3$ and $S_1$' to $S_3$' are electrically isolated by isolator 4. Furthermore, the ends of the flat band conductors $S_1$ to $S_3$ and $S_1$' to $S_3$' are electrically connected in electrical connections 5 and form taps $T_1$'" and $T_2$'", respectively. Both taps $T_1$'" and $T_2$'" are on the same outer side of the winding arrangement for inductive components I8. This is shown in enlargement A5.

In all FIGS. 8-8*d* the windings $W_{A1}$ and $W_{B1}$ are wound around the virtual Axis $A_V$ of the winding arrangement for inductive components I8.

Figure 9:
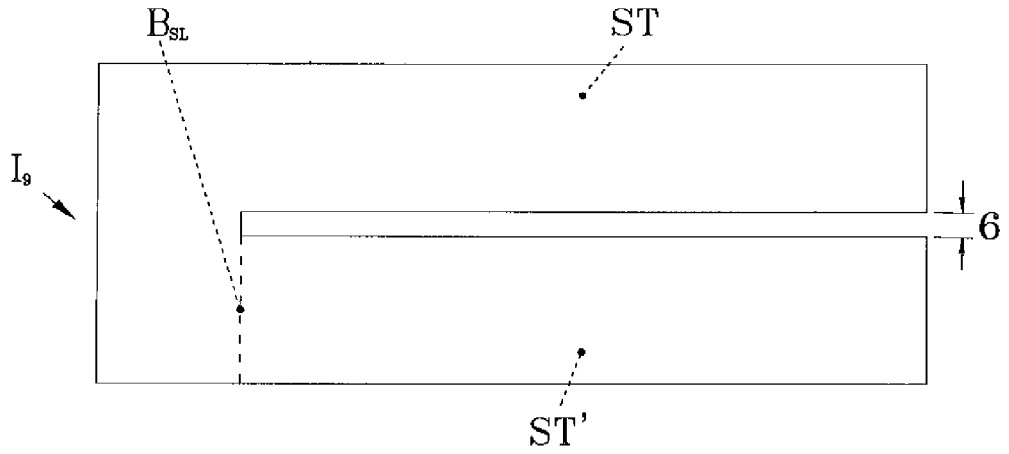
FIG. 9 is a top view of a ninth embodiment of a winding arrangement for inductive components according to the present invention, where a flat band stack is shown in detail.

FIG. 9 is a top view of a ninth embodiment of a winding arrangement for inductive components I9 according to the present invention, where a flat band stack ST, ST' is shown in detail.

The flat band stack ST, ST' in FIG. 9 is essentially u-shaped. Viewed from the front the left arm of the u-shape will form the first flat band stack ST and the right arm of the u-shape will form the second flat band stack ST'. In this case as well as in FIG. 8 the separation of a first flat band stack ST and a second flat band stack ST' is only virtual because the u-shaped flat band stack ST, ST' is arranged as one single geometrically u-shaped flat band stack ST, ST'.

In FIG. 9 the cross connection $C_C$ is formed by a connection element of the u-shaped flat band stack ST, ST' which connects the two arms of the u-shape. Between the right arm of the u-shape and said connection element a straight folding line $B_{SL}$ indicates the section where the right arm of the u-shape has to be bent to form the cross connection $C_C$.

Figure 9A:
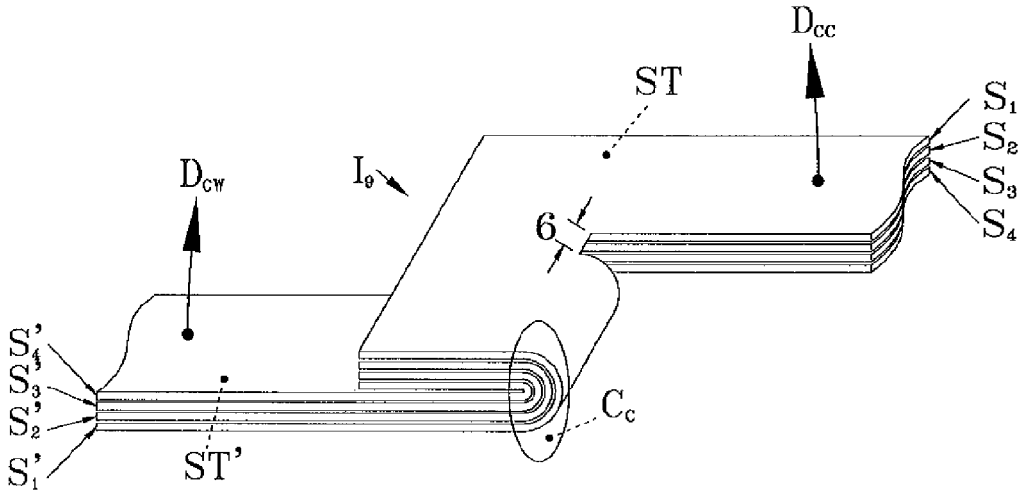
FIG. 9*a,b,c* are perspective views of the flat band stack of the ninth embodiment of the winding arrangement for inductive components shown in FIG. 9 in various winding steps.

FIG. 9*a,b,c* are perspective views of the flat band stack ST, ST' of the ninth embodiment of the winding arrangement for inductive components I9 shown in FIG. 9 in various winding steps The sequence of the figures demonstrates the sequence of the folding procedure.

The u-shaped flat band stack ST, ST' of FIG. 9 is shown in FIG. 9*a* in a perspective side view and comprises four flat band conductors $S_1$ to S4 on the arm which forms the first flat band stack ST, and four flat band conductors $S_1'$ to $S_4'$ on the arm that forms the second flat band stack ST'. In FIG. 9*a* the arm that forms the second flat band stack ST' is bent on the folding line $B_{SL}$ of FIG. 9. Furthermore, the first flat band stack ST and the second flat band stack ST' are arranged at a distance 6 from each other.

The bending that is demonstrated in FIG. 9*a* forms the cross connection $C_C$. The layer stack sequence is changed by the cross connection $C_C$. Accordingly, the first flat band stack ST and the first flat band conductors are arranged in a sequence of $S_1$, $S_2$, $S_3$, $S_4$, while the second flat band stack and the second flat band conductors are arranged in an inverted sequence of $S_4'$, $S_3'$, $S_2'$, $S_1'$.

Figure 9B:
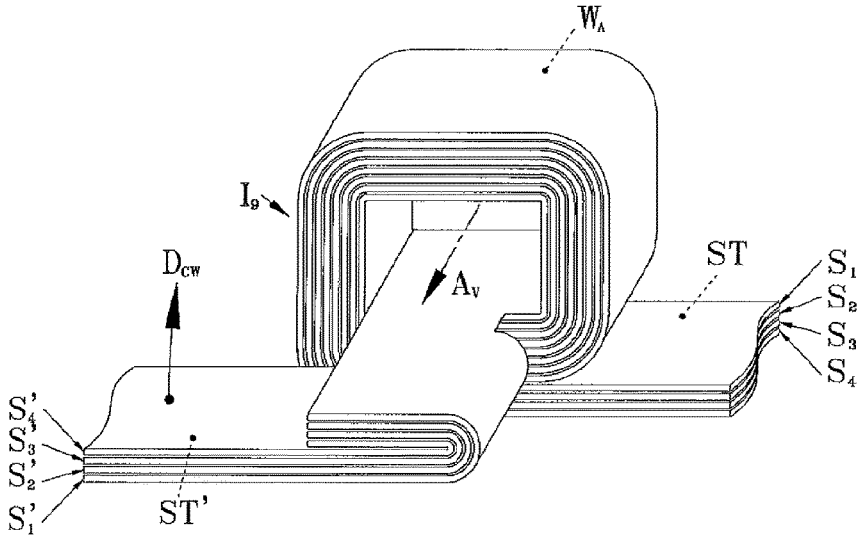

The first winding $W_{A1}$ is wound in the first winding direction $D_{CC}$ counterclockwise as shown in FIG. 9*b*. Accordingly the second winding $B_{B2}$ is wound in the second winding direction $D_{CW}$ clockwise as shown in FIG. 9*c*.

Figure 9C:
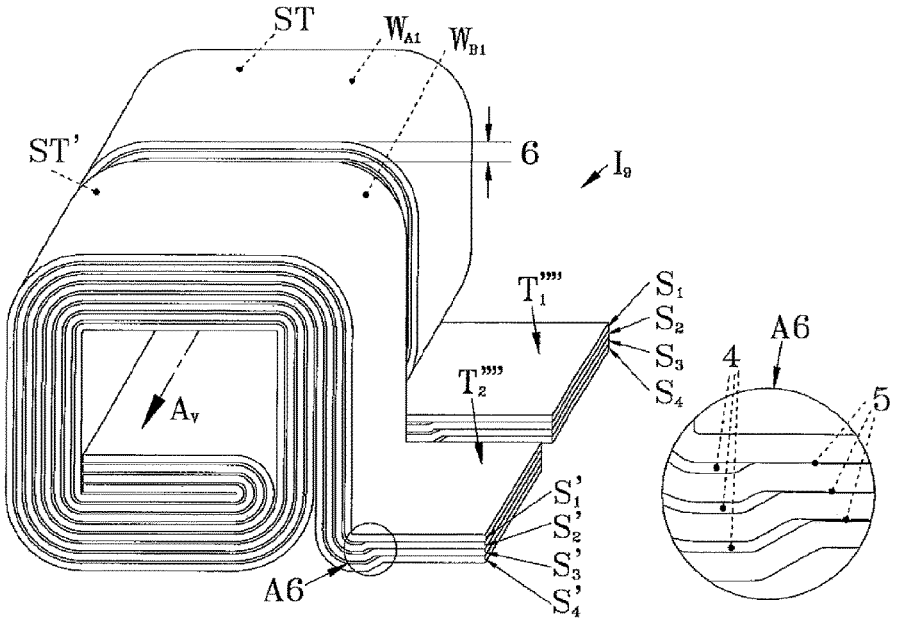

In FIG. 9*c* in an enlargement A6 it is shown that an isolation 4 is arranged between the single flat band conductors $S_1$, $S_2$, $S_3$, $S_4$, and $S_4'$, $S_3'$, $S_2'$, $S_1'$ and that the ends of the flat band conductors $S_1$, $S_2$, $S_3$, $S_4$, and $S_4'$, $S_3'$, $S_2'$, $S_1'$ are electrically connected together in taps $T_1$ and $T_2$, respectively.

Figure 10:
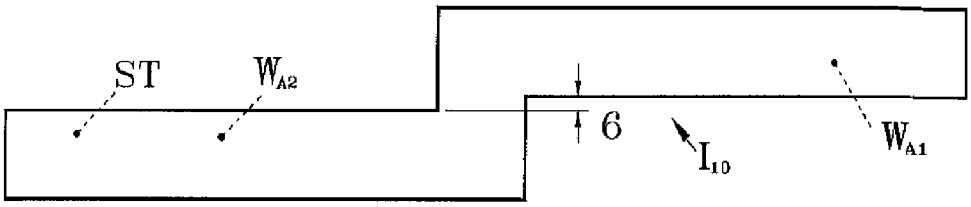
FIG. 10 is a top view of a tenth embodiment of a winding arrangement for inductive components according to the present invention, where a flat band stack is shown in detail.

FIG. 10 is a top view of a tenth embodiment of a winding arrangement for inductive components I10 according to the present invention, where a flat band stack is shown in detail.

In FIG. 10 a preferred embodiment of the first windings $W_{A1}$ and $W_{A2}$ is shown having a direct connection $C_D$ between individual windings $W_{A1}$ and $W_{A2}$. The embodiment of FIG. 10 can be used for any direct connection of two first windings $W_{A1}$-$W_{An}$ or two second windings $W_{B1}$-$W_{Bn}$.

The flat band stack ST in FIG. 10 essentially comprises two parallel arms, which are arranged in parallel, the upper arm extending to the right and the lower arm extending to the left. A connection element places the two parallel arms at a distance 6 from each other and electrically connects the single flat band conductors $S_1$-$S_4$ to each other.

The upper arm will form the first winding $W_{A1}$ and the lower arm will form the first winding $W_{A2}$.

Figure 11:
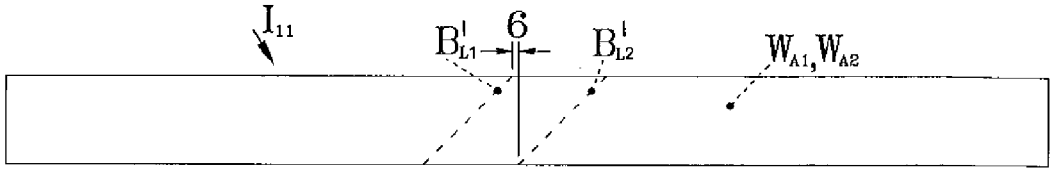
FIG. 11 is a top view of an eleventh embodiment of a winding arrangement for inductive components according to the present invention, where a flat band stack is shown in detail.

FIG. 10 *a,b* are perspective views of the flat band stack ST, ST' of the tenth embodiment I10 shown in FIG. 11 in various winding steps.

Figure 10A:
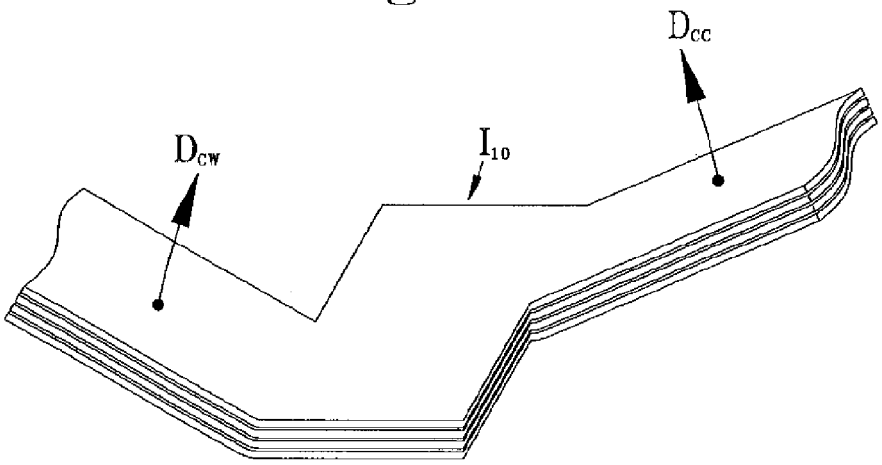
FIG. 10*a,b* are perspective views of the flat band stack of the tenth embodiment of the winding arrangement for inductive components shown in FIG. 10 in various winding steps.

FIG. 10*a* shows the winding directions $D_{CW}$, $D_{CC}$ of the both individual windings $W_{A1}$ and $W_{A2}$. The first winding $W_{A1}$ is wound in the first winding direction $D_{CC}$ counter clockwise and the first winding $W_{A2}$ is wound in the second winding direction $D_{CW}$ clockwise.

Figure 10B:
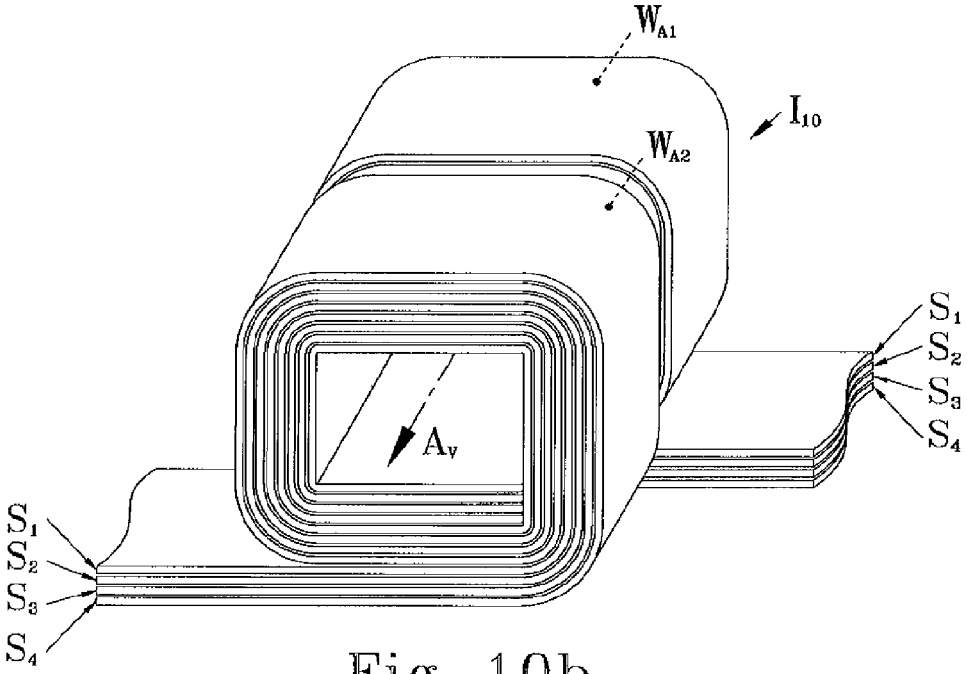

The preferred embodiment of the first windings $W_{A1}$ and $W_{A2}$ according to FIG. 10*b*, which does not change the sequence of flat band conductors $S_1$-$S_4$ offers a possibility of having both strip ends on the outer side of the first winding section $W_A$. Thus, the said flat band conductors $S_1$-$S_4$ can function as one of the taps $T_1$ and $T_2$, respectively, and allow further direct connection $C_D$ or cross connection $C_C$.

FIG. 11 is a top view of an eleventh embodiment of a winding arrangement for inductive components I11 according to the present invention, where a first winding $W_{A1}$ and a second winding $W_{A2}$ are shown in detail.

The first and second windings $W_{A1}$ and $W_{A2}$ of FIG. 11 extend longitudinally such that the length of the flat band is larger than the width of the flat band that forms the first and second windings $W_{A1}$ and $W_{A2}$.

Furthermore, the flat band which forms the first and second windings $W_{A1}$ and $W_{A2}$ comprises two folding lines $B_{L1}'$ and $B_{L2}'$, where the first folding line $B_{L1}'$ extends from the center top of the flat band in a 45° angle down to the left and where the second folding line $B_{L2}'$ extends from the center bottom of the flat band in a 45° angle up to the right. Between the first folding line $B_{L1}'$ and the second folding line $B_{L2}'$ a distance 6 can be arranged in one embodiment.

Figure 11A:
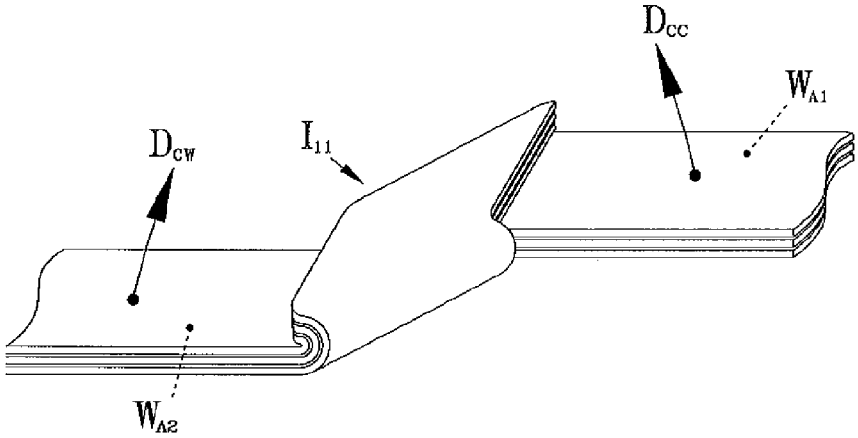
FIG. 11*a,b,c* are perspective views of the flat band stack of the eleventh embodiment of the winding arrangement for inductive components shown in FIG. 11 in various winding steps.
Figure 11B:
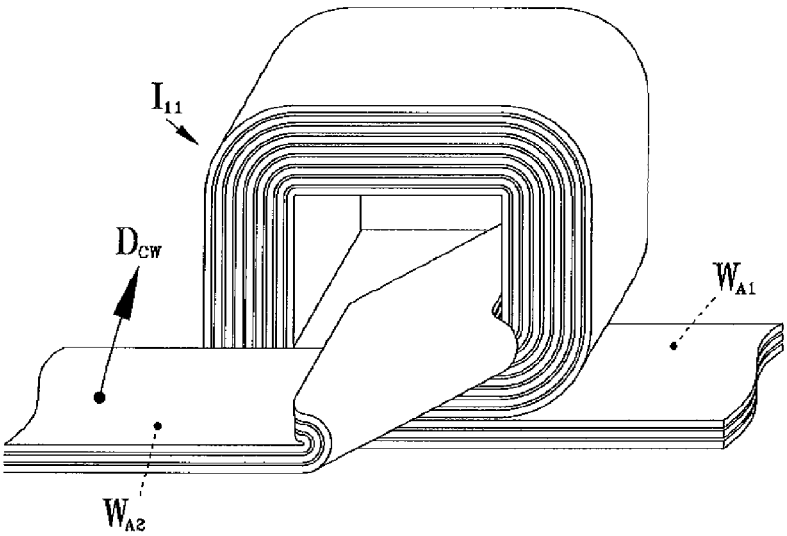
Figure 11C:
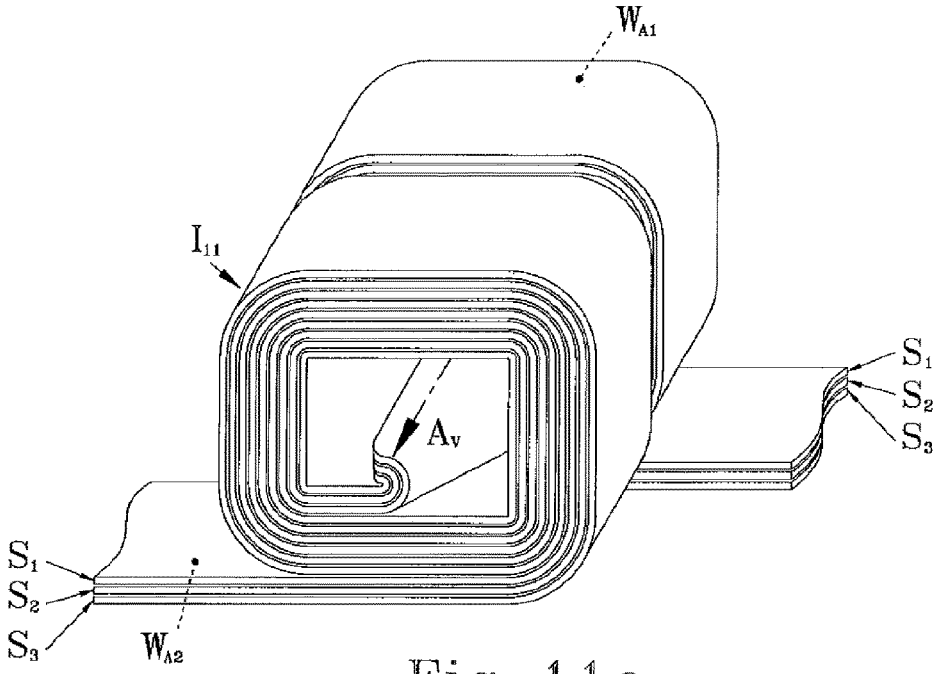

The second preferred embodiment of the winding procedure having a direct connection $C_D$ between individual windings $W_{A1}$ and $W_{A2}$ wound out of the straight isolated flat band is demonstrated in FIGS. 11*a*, 11*b* and 11*c*.

FIGS. 11*a*, 11*b*, 11*c* are perspective views of the flat band first and second windings $W_{A1}$ and $W_{A2}$ of the eleventh embodiment of the winding arrangement for inductive components I11 shown in FIG. 11 in various winding steps.

The direct connection $C_D$ is performed by two bendings along the folding lines $B_{L1}$ and $B_{L2}$ shown in FIG. 11*a*. Both sides of the flat band are bent downwards. This results in an arrangement shown in FIG. 11*a* and sets the ground for winding both individual first windings $W_{A1}$ and $W_{A2}$, each in an opposite direction.

The FIG. 11*b* shows wound first winding $W_{A1}$, while FIG. 11*c* shows the final arrangement with both first windings $W_{A1}$ and $W_{A2}$. The said second preferred embodiment having the direct connection $C_D$ offers the possibility of having both ends of the flat band first and second windings $W_{A1}$ and $W_{A2}$ on the outer side of the first winding section $W_A$, thus, the said flat band conductors $S_1$-$S_3$ function as one of the taps $T_1$ and $T_2$ and allow further direct connection $C_D$ or cross connection $C_C$.

Figure 12:
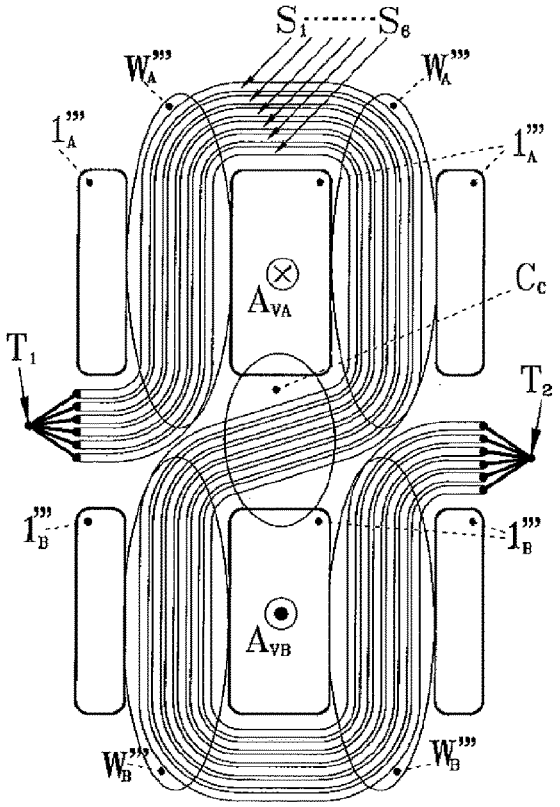
FIG. 12 is an intersection of a planar version of a twelfth embodiment of a winding arrangement for inductive components according to the present invention.

FIG. 12 is an intersection of a planar version of a twelfth embodiment of a winding arrangement for inductive components I12 according to the present invention.

The winding arrangement for inductive components I12 of FIG. 12 comprises six flat band conductors $S_1$-$S_6$. Furthermore, the winding arrangement for inductive components I12 comprises two magnetic cores 1*a*''' and 1*b*''' which are spaced apart such that the six flat band conductors $S_1$-$S_6$ can be passed between the two magnetic cores 1*a*''' and 1*b*'''.

The winding arrangement for inductive components I12 comprises a first winding $W_A'''$ which is formed of six flat band conductors $S_1$-$S_6$ which are wound around the first magnetic core 1*a*''' and passed in between the two magnetic cores 1*a*''' and 1*b*''' to be wound around the second magnetic core 1*b*''', forming a second winding $W_B'''$. The ends of the six flat band conductors $S_1$-$S_6$ are electrically connected together to form a first tap $T_1$ on one end and a second tap $T_2$ on the other end.

In FIG. 12 it becomes apparent, that the cross connection $C_C$ is not formed explicitly by discrete wiring or folding, but, the cross connection $C_C$ is formed implicitly between the two magnetic cores 1*a*''' and 1*b*''' and the s-shaped winding of the six flat band conductors $S_1$-$S_6$ around the two magnetic cores 1*a*''' and 1*b*'''. In FIG. 12 it, furthermore, becomes apparent that the first winding WA''' and the second winding WB''' are wound in contrary directions with respect to the virtual Axis $A_V'$ in order to change the layer sequence.

Figure 13:
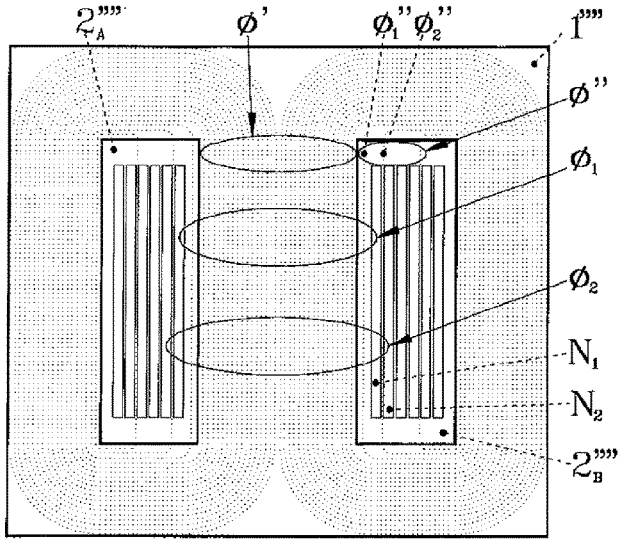
FIG. 13 shows a vertical cross section of an inductive component in order to demonstrate flux lines.

FIG. 13 shows a vertical cross section of an inductive component in order to demonstrate flux lines.

In FIG. 13 reference sign 1'''' denotes the magnetic core and the reference signs 2*a*'''', 2*b*'''' denote a winding window area. The flux lines $\Phi$ are divided into core flux lines $\Phi'=\{\Phi_1' \ldots \Phi_n'\}$; $n \in \mathbb{N}$ and the undesired stressed flux $\Phi''=\{\Phi_1'' \ldots \Phi_n''\}$; $n \in \mathbb{N}$.

Each turn N1, N2 starting from the inside to the outside includes more flux lines, such that the turn $N_1$ includes $\Phi_1$ flux lines, which consists of the core flux $\Phi'$ and $\Phi_1''$ and the turn $N_2$ includes $\Phi_2$ flux lines consisting of the core flux $\Phi'$ plus $\Phi_1''$ and $\Phi_2''$.

Figure 14:
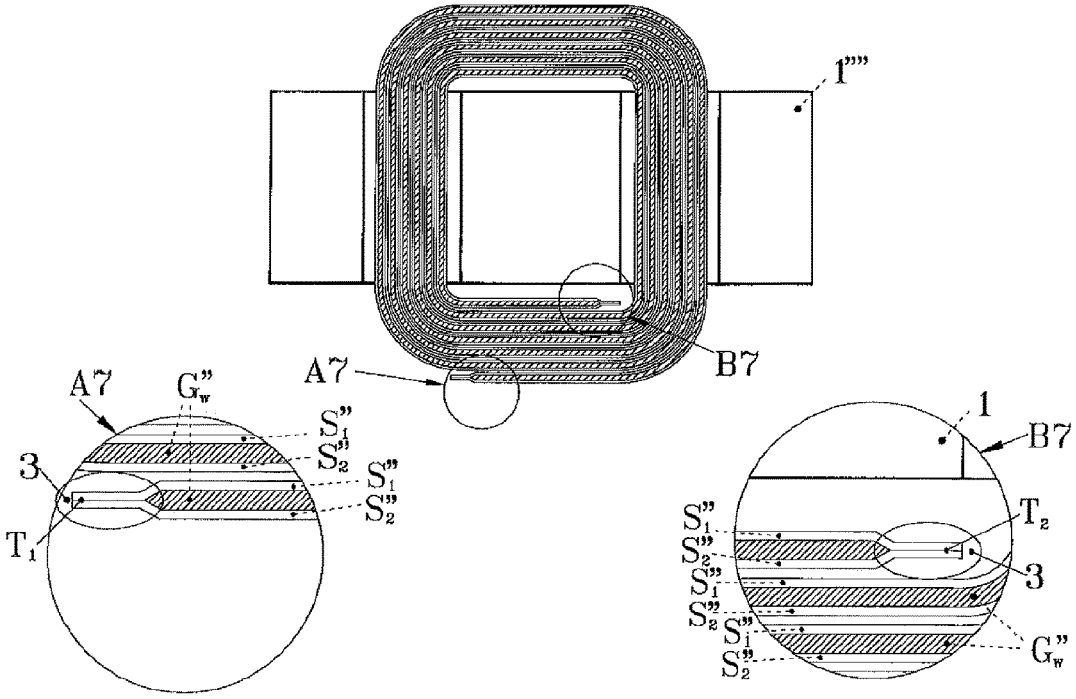
FIG. 14 shows a horizontal cross section of an inductive component of FIG. 13.

FIG. 14 shows a horizontal cross section of an inductive component of FIG. 13.

In FIG. 14 the inductive component comprises a winding which is made out of two insulated parallel flat strips $S_1''$ and $S_2''$ surrounding gap $G_W''$. The strips $S_1''$ and $S_2''$ are connected on both ends in a respective connecting area 3 into taps $T_1$ and $T_2$. The conductive flat strips $S_1$ and $S_2$ form a single flat band conductor. Enlargements A7 and B7 show the arrangement of the flat strips $S_1$ and $S_2$ and the taps $T_1$ and $T_2$.

The winding gap flux $\Phi_g$ as a part of stressed flux $\Phi''$ of FIG. 13 flows through the winding gap $G_W$ of a stretched conductor. This is shown in FIG. 15.

Figure 15:
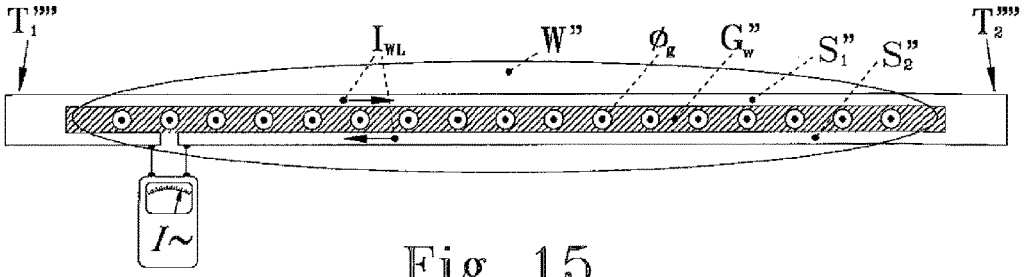
FIG. 15 is a stretched conductor of the inductive component of FIG. 13.

FIG. 15 is a stretched conductor of an inductive component of FIG. 13.

In FIG. 15 the conductor comprises two flat band conductors $S_1''$ and $S_2''$ which are separated by gap $G_W''$. On the ends the flat band conductors $S_1''$ and $S_2''$ are electrically connected in a first tap $T_1''''$ and a second Tap $T_2''''$ respectively.

The winding gap flux $\Phi_g$ is causing the longitudinal equalizing current $I_{WL}$ along the whole length of the stretched conductor, which represents the winding W of the inductive component.

Figure 16:
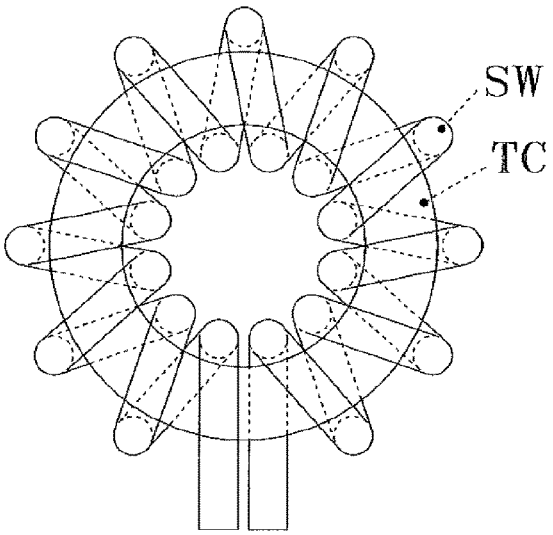
FIG. 16 shows an exemplary inductor.

FIG. 16 shows a common inductor comprising litz wire SW around a toroid core TC.

Although specific embodiments have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

In the foregoing detailed description, various features are grouped together in one or more examples or examples for the purpose of streamlining the disclosure. It is understood that the above description is intended to be illustrative, and not restrictive. It is intended to cover all alternatives, modifications and equivalents as may be included within the scope of the invention. Many other examples will be apparent to one skilled in the art upon reviewing the above specification.

Specific nomenclature used in the foregoing specification is used to provide a thorough understanding of the invention. However, it will be apparent to one skilled in the art in light of the specification provided herein that the specific details are not required in order to practice the invention. Thus, the foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. Throughout the specification, the terms "including" and "in which" are used as the plain-English equivalents of the respective terms "comprising" and "wherein," respectively. Moreover, the terms "first," "second," and "third," etc., are used merely as labels, and are not intended to impose numerical requirements on or to establish a certain ranking of importance of their objects.

REFERENCE SIGNS

I1-I12 winding arrangement for inductive components
$W_A$; $W_A'$; $W_A''$; $W_A'''$ first winding section
$W_B$; $W_B'$; $W_B''$; $W_B'''$ second winding section
$W_{A1}$-$W_{An}$; $W_{A1}'$-$W_{An}'$; $W_{A1}''$-$W_{An}''$ first winding
$W_{B1}$-$W_{Bn}$; $W_{B1}'$-$W_{Bn}'$; $W_{B1}''$-$W_{Bn}''$ second winding
$S_1$-$S_6$; $S_1'$-$S_5'$ flat band conductors
ST first flat band stack
ST' second flat band stack
$D_{CC}$ first winding direction
$D_{CW}$ second winding direction
$C_C$, $C_{C1}$-$C_{C2}$; $C_C$, $C_{C1}$-$C_{C5}$ cross connection
$C_D$, $C_{D1}$-$C_{D2}$; $C_D$, $C_{D1}$-$C_{D5}$ direct connection
T1, T2; T1', T2'; T1'', T2'' electric tap
$A_V$, $A_V'$ virtual axis
$G_W''$ gap
1; 1'; 1'', 1*a*'''', 1*b*'''' magnetic core
2; 2*a*', 2*b*'; 2*a*'', 2*b*'' winding window
4 isolator
5 electrical connection
6 distance
A-A7, B-B7 enlargement

The invention claimed is:

1. A winding arrangement for inductive components, comprising:

a magnetic core arranged in a virtual axis of the winding arrangement;

a first winding section comprising at least one first winding;

a second winding section comprising at least one second winding;

the at least one first winding being wound around the core in a first winding direction with regard to the virtual axis and the at least one second winding being wound around the core laterally adjacent to the at least one first winding in a second winding direction which is opposite to the first winding direction with regard to the virtual axis;

wherein the winding arrangement is formed out of at least two flat band conductors having a U-shape, the at least two flat band conductors being arranged in a stack to form a U-shaped flat band stack;

wherein the at least one first winding section comprises a first arm of the U-shaped flat band stack configured as a first flat band stack and the at least one second winding section comprises a second arm of the U-shaped flat band stack configured as a second flat band stack;

wherein the first arm of the U-shaped flat band stack and the second arm of the U-shaped flat band stack are cross connected in a cross connection such that a first current flow stacking sequence in the first flat band stack is reversed to a second current flow stacking sequence in the second flat band stack;

wherein the cross connection is formed with a single 180° bending over a bending line, the bending line being parallel to the virtual axis of the winding arrangement;

wherein first free ends of the flat band conductors of the first winding section are at least electrically connected together in a first electric tap; and wherein second free ends of the flat band conductors of the second winding section are at least electrically connected together in a second electric tap.

2. The winding arrangement for inductive components according to claim 1, wherein:

the first winding section comprises a plurality of first windings, the electrical conductors of the plurality of first windings are connected electrically in series in a direct connection, the plurality of first windings are wound in alternating directions, the second winding section comprises a plurality of second windings, the electrical conductors of the plurality of second windings are connected electrically in series in a direct connection, and the plurality of second windings are wound in alternating directions.

3. The winding arrangement for inductive components according to claim 1, wherein the first winding section and the second winding section are configured essentially symmetrical.

4. The winding arrangement for inductive components according to claim 1, wherein the cross connection is arranged at the innermost loop of the at least one first winding and the at least one second winding.

5. The winding arrangement for inductive components according to claim 1, wherein the cross connection is arranged at the outermost loop of the at least one first winding and the at least one second winding.

6. The winding arrangement for inductive components according to claim 1, wherein the cross connection is implemented by an electric wiring arrangement.

7. The winding arrangement for inductive components according to claim 1, wherein the winding arrangement is included in a transformer.

8. The winding arrangement for inductive components according to claim 1, wherein:

the U-shaped flat band stack is formed out of at least two flat band conductors having an I-shape by folding arrangement with two bendings.

9. A method for manufacturing a winding arrangement for inductive components, comprising:

providing a single longitudinal flat band stack comprising at least two electrically isolated parallel flat band conductors;

dividing the single longitudinal flat band stack into a first arm and a second arm by implementing a folding arrangement, such that cross connection is performed at the half of the length of the flat band conductors, such that a current flow stacking sequence in the first arm is reversed to a second current flow stacking sequence in the second arm, the folding arrangement being implemented by forming a U-shape with two bendings of the single longitudinal flat band stack and changing a layer sequence of the single longitudinal flat band stack with an additional bending of the single longitudinal flat band stack such that longitudinal currents caused by flux differences of individual ones of the at least two electrically isolated parallel flat band conductors are minimized;

winding the first arm in a first winding direction with regard to a virtual axis of the winding arrangement for inductive components to form a first winding section comprising at least one first winding;

winding the second arm in a second winding direction opposite to the first winding direction with regard to the virtual axis of the winding arrangement for inductive components to form a second winding section comprising at least one second winding;

connecting second ends of the flat band conductors of the first winding section at least electrically in a first electric tap; and connecting second ends of the flat band conductors of the second winding section at least electrically in a second electric tap.

10. A method for manufacturing a winding arrangement for inductive components, comprising:

providing a u-shaped flat band stack comprising at least two electrically isolated parallel flat band conductors;

dividing the u-shaped flat band stack into a first arm and a second arm by implementing a folding arrangement, such that cross connection is performed at the half of the length of the flat band conductors, such that a current flow stacking sequence in the first arm is reversed to a second current flow stacking sequence in the second arm;

winding the first arm in a first winding direction with regard to a virtual axis of the winding arrangement for inductive components to form a first winding section comprising at least one first winding;

winding the second arm in a second winding direction opposite to the first winding direction with regard to the virtual axis of the winding arrangement for inductive components to form a second winding section comprising at least one second winding;

connecting second ends of the flat band conductors of the first winding section at least electrically in a first electric tap; and connecting second ends of the flat band conductors of the second winding section at least electrically in a second electric tap.

11. A winding arrangement for inductive components, comprising:

a magnetic core arranged in a virtual axis of the winding arrangement;

a first winding section comprising a plurality first windings wound around the magnetic core laterally adjacent to one another, each winding in the plurality of first windings comprising at least two electrically isolated parallel flat band conductors being configured as a first flat band stack, the flat band conductors of the plurality of first windings being electrically connected in series in a direct connection, the plurality of first windings being wound in alternating directions with regard to the virtual axis;

a second winding section comprising a plurality second windings wound around the magnetic core laterally adjacent to one another, each winding in the plurality of second windings comprising at least two electrically isolated parallel flat band conductors being configured as a second flat band stack, the flat band conductors of the plurality of second windings being electrically connected in series in a direct connection, the plurality of second windings being wound in alternating directions with regard to the virtual axis;

wherein first ends of the flat band conductors of the first winding section are cross connected in a cross connection to first ends of the flat band conductors of the second winding section such that a first current flow stacking sequence in the first flat band stacks is reversed to a second current flow stacking sequence in the second flat band stacks;

wherein second ends of the flat band conductors of the first winding section are at least electrically connected together in a first electric tap; and wherein second ends of the flat band conductors of the second winding section are at least electrically connected together in a second electric tap.

* * * * *